US007735479B1

(12) United States Patent
Quinn et al.

(10) Patent No.: US 7,735,479 B1
(45) Date of Patent: Jun. 15, 2010

(54) HOLLOW TUBE PAINTBALL MARKER

(76) Inventors: Michael Vincent Quinn, 42 Tiffany Dr., East Hanover, NJ (US) 07936; Kerry Johnson, 126 Woodland Rd., Madison, NJ (US) 07940

( * ) Notice: Subject to any disclaimer, the term of this patent is extended or adjusted under 35 U.S.C. 154(b) by 3 days.

(21) Appl. No.: 12/154,845

(22) Filed: May 27, 2008

Related U.S. Application Data

(60) Provisional application No. 60/931,767, filed on May 26, 2007.

(51) Int. Cl.
*F41B 11/00* (2006.01)

(52) U.S. Cl. ..... 124/73; 124/60; 124/75; 124/76; 124/74; 124/77

(58) Field of Classification Search ..... 124/60, 124/75, 76, 73, 74, 77
See application file for complete search history.

(56) References Cited

U.S. PATENT DOCUMENTS

| | | | | |
|---|---|---|---|---|
| 645,932 | A | 3/1900 | Beck et al. | |
| 1,167,178 | A | 1/1916 | Hill | |
| 1,343,127 | A | 6/1920 | Hallinan | |
| 1,743,576 | A | 1/1930 | Smith | |
| 2,550,887 | A | 5/1951 | Tratsch | 124/1 |
| 2,568,432 | A | 9/1951 | Cook | 124/13 |
| 2,845,055 | A | 7/1958 | Collins et al. | 124/11 |
| 3,089,476 | A | 5/1963 | Wolverton | 124/11 |
| 3,494,344 | A | 2/1970 | Vadas et al. | 124/11 |
| 3,572,310 | A | 3/1971 | Chiba | 124/11 |
| 3,695,246 | A | 10/1972 | Filippi et al. | 124/11 |
| 3,818,887 | A | 6/1974 | Akiyama et al. | 124/15 |
| 4,066,000 | A | 1/1978 | Rostocil | 89/198 |
| 4,589,327 | A | 5/1986 | Smith | 89/148 |
| 4,679,487 | A | 7/1987 | Houseman | 89/140 |
| 4,694,815 | A | 9/1987 | Hung | 124/27 |
| 4,770,153 | A | 9/1988 | Edelman | 124/72 |
| 4,779,245 | A | 10/1988 | Chelminski | 367/144 |
| 4,819,609 | A | 4/1989 | Tippmann | 124/72 |
| 4,899,717 | A | 2/1990 | Rutten et al. | 124/67 |
| 4,936,282 | A | 6/1990 | Dobbins et al. | 124/74 |
| 5,063,905 | A | 11/1991 | Farrell | 124/72 |
| 5,078,118 | A * | 1/1992 | Perrone | 124/74 |
| 5,228,427 | A | 7/1993 | Gardner, Jr. | 124/71 |
| 5,261,384 | A | 11/1993 | Hu | 124/66 |
| 5,280,778 | A * | 1/1994 | Kotsiopoulos | 124/73 |
| 5,282,454 | A | 2/1994 | Bell et al. | 124/49 |
| 5,462,042 | A | 10/1995 | Greenwell | 124/76 |
| 5,503,137 | A | 4/1996 | Fusco | 124/72 |
| 5,613,483 | A | 3/1997 | Lukas et al. | 124/73 |
| 5,634,456 | A | 6/1997 | Perrone | 124/76 |

(Continued)

*Primary Examiner*—Troy Chambers
*Assistant Examiner*—Samir Abdosh
(74) *Attorney, Agent, or Firm*—Keisling + Pieper PLC; David B. Pieper

(57) ABSTRACT

A paintball marker for launching a paintball using a bolt with an internal impact ring for contacting a power tube sized to fit within the bolt. The power tube has an internal gas passage for supplying launching gas to the paintball and an external striking surface that is contacted by the bolt's impact ring. A main seal is positioned selectively seal the internal passage of the power tube from a gas supply. Movement of the bolt causes the impact ring to contact the striking surface to unseat the power tube from the main seal to release gas from the main gas chamber through the internal passage into the breach to launch the paintball.

2 Claims, 2 Drawing Sheets

U.S. PATENT DOCUMENTS

| | | | | |
|---|---|---|---|---|
| 5,727,538 | A | 3/1998 | Ellis | 124/77 |
| 5,736,720 | A | 4/1998 | Bell et al. | 235/1 |
| 5,816,232 | A | 10/1998 | Bell | 124/51.1 |
| 5,878,736 | A | 3/1999 | Lotuaco, III | 124/71 |
| 5,881,707 | A | 3/1999 | Gardner, Jr. | 124/77 |
| 5,890,479 | A | 4/1999 | Morin | 124/31 |
| 5,913,303 | A | 6/1999 | Kotsiopoulos | 124/31 |
| 5,967,133 | A | 10/1999 | Gardner, Jr. | 124/77 |
| 6,003,504 | A | 12/1999 | Rice et al. | 124/73 |
| 6,035,843 | A | 3/2000 | Smith et al. | 124/77 |
| 6,065,460 | A | 5/2000 | Lotuaco, III | 124/72 |
| 6,138,656 | A | 10/2000 | Rice et al. | 124/73 |
| 6,142,137 | A | 11/2000 | MacLaughlin | 124/72 |
| 6,349,711 | B1 | 2/2002 | Perry et al. | 124/73 |
| 6,439,217 | B1 | 8/2002 | Shih | 124/77 |
| 6,474,326 | B1 | 11/2002 | Smith et al. | 124/77 |
| 6,532,949 | B1 | 3/2003 | McKendrick | 124/77 |
| 6,553,983 | B1 | 4/2003 | Li | 124/73 |
| 6,590,386 | B1 | 7/2003 | Williams | 324/178 |
| 6,615,814 | B1 | 9/2003 | Rice et al. | 124/71 |
| 6,637,420 | B2 * | 10/2003 | Moritz | 124/73 |
| 6,637,421 | B2 | 10/2003 | Smith et al. | 124/77 |
| 6,644,295 | B2 * | 11/2003 | Jones | 124/77 |
| 6,694,963 | B1 | 2/2004 | Taylor | 124/32 |
| 6,739,322 | B2 | 5/2004 | Rice et al. | 124/49 |
| 6,763,822 | B1 | 7/2004 | Styles | 124/77 |
| 6,802,306 | B1 | 10/2004 | Rice | 124/74 |
| 6,810,871 | B2 * | 11/2004 | Jones | 124/77 |
| 7,401,607 | B2 * | 7/2008 | Yeh | 124/74 |
| 7,520,275 | B2 * | 4/2009 | Long | 124/73 |
| 7,527,049 | B2 * | 5/2009 | Sheng | 124/73 |
| 2004/0089280 | A1 * | 5/2004 | Kunimoto | 124/76 |
| 2006/0011187 | A1 * | 1/2006 | Gardner et al. | 124/73 |
| 2007/0017497 | A1 * | 1/2007 | Masse | 124/73 |
| 2007/0068502 | A1 * | 3/2007 | Jones et al. | 124/77 |
| 2007/0209650 | A1 * | 9/2007 | Jones | 124/73 |
| 2008/0099005 | A1 * | 5/2008 | Kaakkola et al. | 124/74 |

* cited by examiner

HOLLOW TUBE PAINTBALL MARKER

CROSS-REFERENCE TO RELATED APPLICATIONS

This application claims priority to and is a continuation-in-part of U.S. Application Ser. No. 60/931,767, filed May 26, 2007.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in constructions for valves for compressed gas control. More particularly, the invention relates to improvements particularly suited for controlling internal operation of gas release valves in paintball markers.

2. Description of the Known Art

The game of paintball uses pneumatic guns that frangible capsules containing a marking material (paintballs). Participants fire the paintballs in an attempt to hit the other player and "mark" them as eliminated from the game. Thus, the physical devices used to launch the paintball are called "markers." These markers have two basic mechanisms including one for loading the paintball into the firing position and the other for releasing a quantity of gas to launch the paintball from the marker.

The original style of paintball markers used a two tube system with one tube housing a bolt that loads a paintball into position and another tube housing a poppet valve for releasing a quantity of Compressed gas. In these designs a hammer in the lower tube is connected to a bolt in the upper tube and the two usually move together to chamber a ball and strike a poppet style pin valve. While the setup requires few o-rings it has its drawbacks in needing separate components for the bolt and hammer, a connecting linkage between the two, a large body and heavy springs to generate the force required to open the poppet valve.

Newer marker designs are incorporating the valve and bolt into a single tube to reduce the material costs of the paintball marker. These single tube designs are commonly referred to as "spool valve" style guns. The bolt is moved axially forward to chamber the ball into the breach. At the apex of the motion either a valve is released or the bolt moves past some form of seal that allows high pressure gas to enter the breach and propel the ball out of the barrel.

The bolt is usually moved by means of applying gas pressure to a chamber on the outside of the bolt which then acts against a lip on the bolt's exterior. The main gas pressure chamber is usually behind the bolt or around a rear section of the bolt. While this design provides for a fast actuation and a simple design, it also requires a significant amount of axial length to accommodate the necessary components. Furthermore, the number of seals required for these designs introduces a large amount of friction force. The friction force can vary from shot to shot which causes inconsistent ball release and launching speed. This variation can cause variation in how long the bolt is forward and how much gas is released to the ball. To minimize the variations in how much gas is released to the ball, some of these "spool valve" markers incorporate an "on-off" mechanism as part of the bolt. When the bolt is rearward a gas chamber is allowed to fill with gas. When the bolt moves forward it closes the chamber off to any more incoming gas. The chambered gas is what propels the ball when the gun fires. This on-off mechanism necessitates more seals, and hence more complexity to the paintball gun. Finally, the use of an exterior lip on the bolt to propel it forward and rearward usually makes the gas passages from the air chamber to the ball smaller then they might otherwise be. The small passages create the need for higher gas pressures to move the needed gas from the chamber to the ball. These higher pressures tend to make the internal seals fail faster and further contribute to the increase in friction with these designs. These higher pressures also make it necessary to use high pressure solenoid valves to actuate the bolt or a secondary pressure regulator to allow use of standard, low pressure solenoid valves. Both situations increase the cost of the paintball marker.

As will be appreciated by those skilled in the art, launching device have been known for a long time. Patents disclosing information relevant to projectile launching devices includes: U.S. Pat. No. 645,932, issued to Ferrant on Mar. 27, 1900; U.S. Pat. No. 1,167,178, issued to Hill on Jan. 4, 2016; U.S. Pat. No. 1,343,127, issued to Hallinan on Jun. 8, 2020; U.S. Pat. No. 1,743,576, issued to Smith on Jan. 14, 1930; U.S. Pat. No. 2,550,887, issued to Tratsch on May 1, 1951; U.S. Pat. No. 2,568,432, issued to Cook on Sep. 18, 1951; U.S. Pat. No. 2,845,055, issued to Collins et al. on Jul. 29, 1958; U.S. Pat. No. 3,089,476, issued to Wolverton on May 14, 1963; U.S. Pat. No. 3,494,344, issued to Vadas et al. on Feb. 10, 1970; U.S. Pat. No. 3,572,310, issued to Kensuke Chiba on Mar. 23, 1971; U.S. Pat. No. 3,695,246, issued to Filippi et al. on Oct. 3, 1972; U.S. Pat. No. 3,818,887, issued to Akiyama et al. on Jun. 25, 1974; U.S. Pat. No. 4,066,000, issued to Rostocil on Jan. 3, 1978; U.S. Pat. No. 4,589,327 issued to Smith on May 20, 1986; U.S. Pat. No. 4,679,487, issued to Houseman on Jul. 14, 1987; U.S. Pat. No. 4,694,815, issued to Hung on Sep. 22, 1987; U.S. Pat. No. 4,770,153, issued to Edelman on Sep. 13, 1988; U.S. Pat. No. 4,779,245, issued to Chelminski on Oct. 18, 1988; U.S. Pat. No. 4,819,609, issued to Tippmann on Apr. 11, 1989; U.S. Pat. No. 4,899,717, issued to Rutten et al. on Feb. 13, 1990; U.S. Pat. No. 4,936,282, issued to Dobbins et al. on Jun. 26, 1990; U.S. Pat. No. 5,063,905, issued to Farrell on Dec. 12, 1991; U.S. Pat. No. 5,078,118, issued to Perrone on Jan. 7, 1992; U.S. Pat. No. 5,228,427, issued to Gardner, Jr. on Jul. 20, 1993; U.S. Pat. No. 5,261,384, issued to Hu on Nov. 16, 1993; U.S. Pat. No. 5,280,778, issued to Kotsiopoulos on Jan. 25, 1994; U.S. Pat. No. 5,282,454, issued to Bell, et al. on Feb. 1, 1994; U.S. Pat. No. 5,462,042, issued to Grenwell on Oct. 31, 1995; U.S. Pat. No. 5,503,137, issued to Fusco on Apr. 2, 1996; U.S. Pat. No. 5,613,483, issued to Lukas et al. on Mar. 25, 1997; U.S. Pat. No. 5,634,456, issued to Perrone on Jun. 3, 1997; U.S. Pat. No. 5,727, 538, issued to Ellis on Mar. 17, 1998; U.S. Pat. No. 5,736,720, issued to Bell, et al. on Apr. 7, 1998; U.S. Pat. No. 5,816,232, issued to Bell on Oct. 6, 1998; U.S. Pat. No. 5,878,736, issued to Lotuaco, III on Mar. 9, 1999; U.S. Pat. No. 5,881,707, issued to Gardner, Jr. on Mar. 16, 1999; U.S. Pat. No. 5,890,479, issued to Morin on Apr. 6, 1999; U.S. Pat. No. 5,913,303, issued to Kotsiopoulos on Jun. 22, 1999; U.S. Pat. No. 5,967,133, issued to Gardner, Jr. on Oct. 19, 1999; U.S. Pat. No. 6,003,504, issued to Rice et al. on Dec. 21, 1999; U.S. Pat. No. 6,035,843, issued to Smith et al. on Mar. 14, 2000; U.S. Pat. No. 6,065,460, issued to Lotuaco, III on May 23, 2000; U.S. Pat. No. 6,138,656, issued to Rice et al. on Oct. 31, 2000; U.S. Pat. No. 6,142,137, issued to MacLaughlin on Nov. 7, 2000; U.S. Pat. No. 6,349,711, issued to Perry et al. on Feb. 26, 2002; U.S. Pat. No. 6,439,217, issued to Shih on Aug. 27, 2002; U.S. Pat. No. 6,474,326, issued to Smith et al. on Nov. 5, 2002; U.S. Pat. No. 6,532,949, issued to McKendrick on Mar. 18, 2003; U.S. Pat. No. 6,553,983, issued to Li on Apr. 29, 2003; U.S. Pat. No. 6,590,386, issued to Williams on Jul. 8, 2003; U.S. Pat. No. 6,615,814, issued to Rice et al. on Sep. 9, 2003; U.S. Pat. No. 6,637,420, issued to Moritz on Oct. 28, 2003; U.S. Pat. No. 6,637,421, issued to Smith et al. on Oct. 28, 2003; U.S. Pat. No. 6,644,295, issued to Jones on Nov. 11, 2003; U.S. Pat. No. 6,694,963, issued to Taylor on Feb. 24, 2004; U.S. Pat. No. 6,739,322, issued to Rice, et al. on May 25, 2004; U.S. Pat. No. 6,763,822, issued to Styles on Jul. 20, 2004; and U.S. Pat. No. 6,802,306, issued to Rice on Oct. 12, 2004. Each of these patents is hereby expressly incorporated by reference in their entirety.

Even with this plethora of designs, these prior art systems continue to have the major disadvantages previously discussed. Thus, it may be seen that these prior art patents are very limited in their teaching and utilization, and an improved paintball marker is needed to overcome these limitations.

SUMMARY OF THE INVENTION

The present invention is directed to an improved paintball marker using a bolt and power tube combination. In accordance with one exemplary embodiment of the present invention, a paintball marker for launching a paintball is provided using a bolt with an internal impact ring for contacting a power tube that is sized to fit within the bolt. The power tube has an internal gas passage for supplying launching gas to the paintball and an external striking surface that is contacted by the bolt's impact ring. A main seal is positioned selectively seal the internal passage of the power tube from a gas supply. Movement of the bolt causes the impact ring to contact the striking surface to unseat the power tube from the main seal to release gas from the main gas chamber through the internal passage into the breach to launch the paintball.

One advantage of the present invention is the provision of a valve that is more compact in size and reduces the overall length and complexity of the paintball marker. This present design operates with the minimum amount of seals, and only requires two internal main passage seals. Furthermore the design provides for large air passages to minimize the pressure needed to operate the marker and requires relatively little force to open the valve that fires the ball.

Finally, the mechanism is adaptable to most popular bolt actuating designs, including but not limited to, open bolt blowback, open bolt air forward spring return, open bolt air forward air return, closed bolt with a separate hammer mechanism, electro-pneumatic, and mechanical grip frames.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
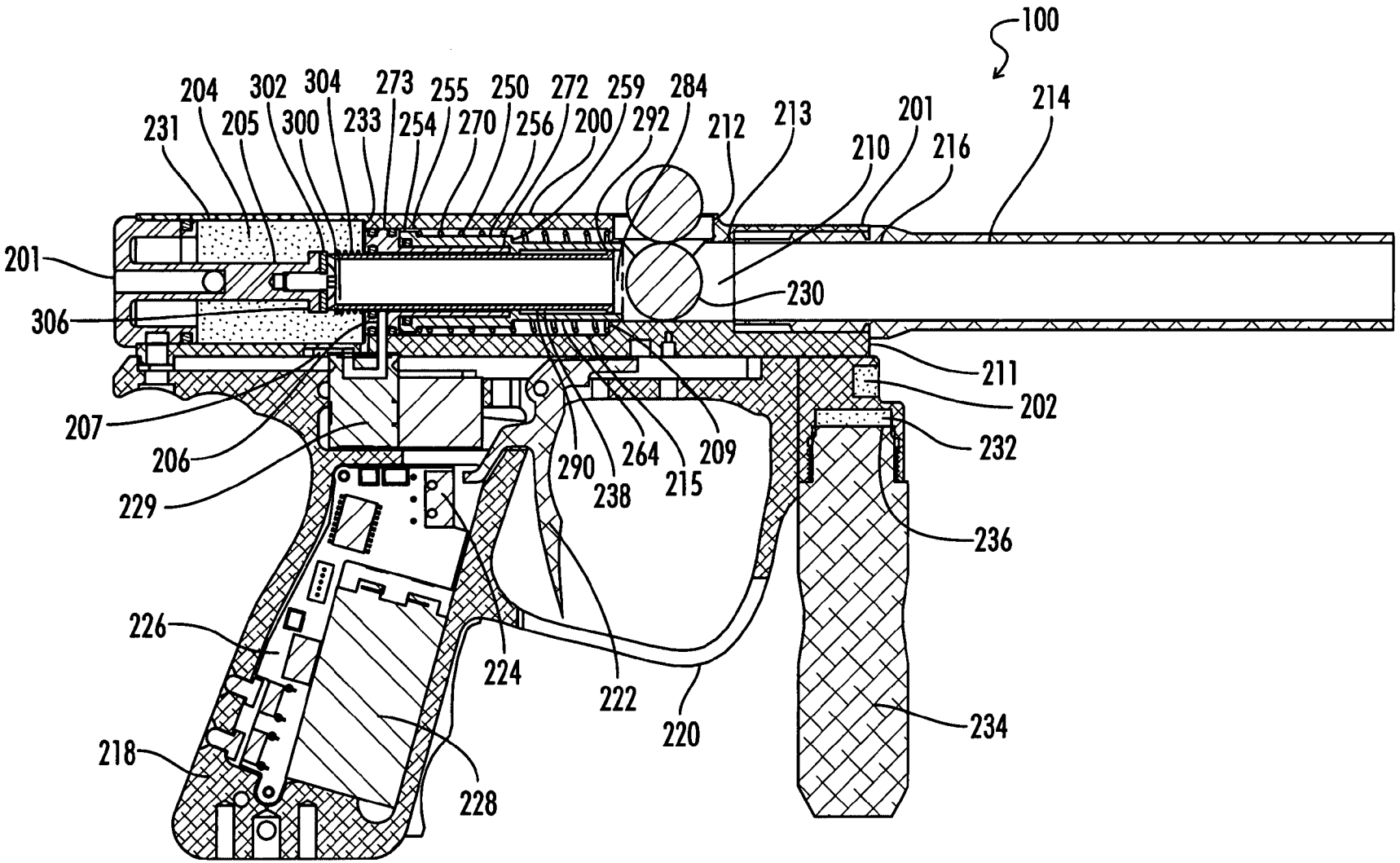
FIG. 1 is a schematic view of a paintball gun showing the internal loading position.

As shown in FIG. 1 of the drawings, one exemplary embodiment of the present invention is generally shown as a paintball marker 100. The paintball marker 100 includes a main body 200 with a barrel 214 attached to the front 201 of the main body 200, a grip frame 218 connected to the bottom 211 of the main body 200, and also a pressure regulator 234 connected to the bottom 211 of the main body 200 to supply pressurized gas 232 into the main body 200.

The main body 200 defines both a main gas passage 202 that allows for pressurized gas 232 to flow into the main gas chamber 204 and the valve 229, a separate controlling gas passage 206 that is connected to a bolt chamber 208 and the valve 229, and an atmospheric pressure passage 207 that is connected to the valve 229. These chambers and passageways are used by the valve 229 to control the supply and quantity of gas released into the breach 210 of the main body 200. The breech 210 has a first initial diameter 213 sized to the paintball 230, the bolt chamber 208 has a bolt stop shoulder 209 which steps up to the second diameter 215, and then a main shoulder 233 steps up to the main chamber diameter 231. A seal support 201 is used to seal the main chamber diameter 231 of the main gas chamber 204. A paintball supply passage 212 is also connected to the breach 210 so that paintballs 230 can be supplied into the breach 210. The barrel 214 is connected to front 201 of the main body 200 so that the paintballs 230 can be loaded from the breach 210 into the rear 216 of the barrel 214.

Pressurized gas 232 is supplied from an external source (not shown) through the pressure regulator 234. The outlet 236 of the pressure regulator 234 is connected to the main gas passage 202 to supply the pressurized gas into the main gas chamber 204.

A grip frame 218 is connected to the bottom 211 of the main body 200. The grip frame 218 includes a trigger guard 220 protecting a trigger 222 and internally houses a trigger switch 224 connected to a circuit board 226 powered by a battery 228. The circuit board 226 controls the operation of a three way valve 229. The three way valve 229 is connected between the main gas chamber 204 and the controlling gas passage 206, and the controlling gas passage 206 and the atmospheric pressure passage 207.

A bolt 250 is mounted within the main body 200 in the bolt chamber 208. The bolt 250 has a front 252 defining bolt gas passages 262, a back 254 with a spring contact ring 255, an outer surface 256 with a shoulder stop 257, and a front inner surface 258 with an internal impact ring 260 and a back internal diameter 259 within the bolt 250. The bolt moves between the loading position 264 shown in FIG. 1 and the firing position 266 shown in FIG. 2. The bolt 250 slides over an annular cylinder 272 and is slideably sealed with the annular cylinder 272 by a bolt seal 268. The bolt 250 is biased backwards by a bolt spring 270 that pushed against both the spring contact ring 255 of the bolt 250 and the bolt stop shoulder 209 of the main body 200.

The annual cylinder 272 has a back face 279 with chamber diameter 273 matching the bolt chamber 208 with face step 278 to a bolt diameter 276 matching the back internal diameter 259 of the bolt 250, and an internal diameter 277 for holding the power tube 280. In addition to the seal to the bolt 250, the annual cylinder 272 is sealed to the main body 200 by sealing rings 274 and is sealed to the power tube 280 by the tube seal 275.

The power tube 280 has an inside 282 defining an internal tube passage 283, a front 284, a back sealing surface 286, and an outer surface 288 with a main body diameter 290 and a striking surface 292. An outer pressure ring 300 is mounted to the outer surface 288 of the power tube 280 so that a valve spring 304 can biased the power tube 280 backwards in relation to the main body 200 to press against the main seal 302 that is mounted on the chamber extension 205 to form the release valve 306.

Operation of the paintball marker 100 can be understood from this construction. Paintballs 230 are fed downwardly through the paintball supply passage 212 into the breech 210 in front of the bolt 250. Pressurized gas 232 such as compressed air, nitrogen, or CO2 is supplied to the pressure regulator 234 from a tank or supply line (not shown). The pressure regulator 234 regulates the incoming gas and supplies this regulated pressurized gas 232 at outlet 236. The outlet 236 is flowably connected to the main gas passage 202 to supply gas into the main gas chamber 204. The main gas passage 202 can be an internal channel or an external hose that connects the outlet 236 to the chamber 204.

The control valve 229 is a solenoid 3-way valve that is controlled by the circuit board 226 according to the operation of the trigger 222. FIG. 1 shows the control valve 229 connecting the controlling gas passage 206 to the atmospheric pressure passage 207. With only atmospheric pressure on the back of the bolt 250, the bolt spring 270 forces the bolt into the loading position 264 shown in FIG. 1. Similarly, the release valve spring 304 seats the power tube 280 against the main seal 302. Thus, the paintball 230 is loaded in the breach 210 and the main gas chamber 204 is charged so that the marker 100 is ready to fire.

Figure 2:
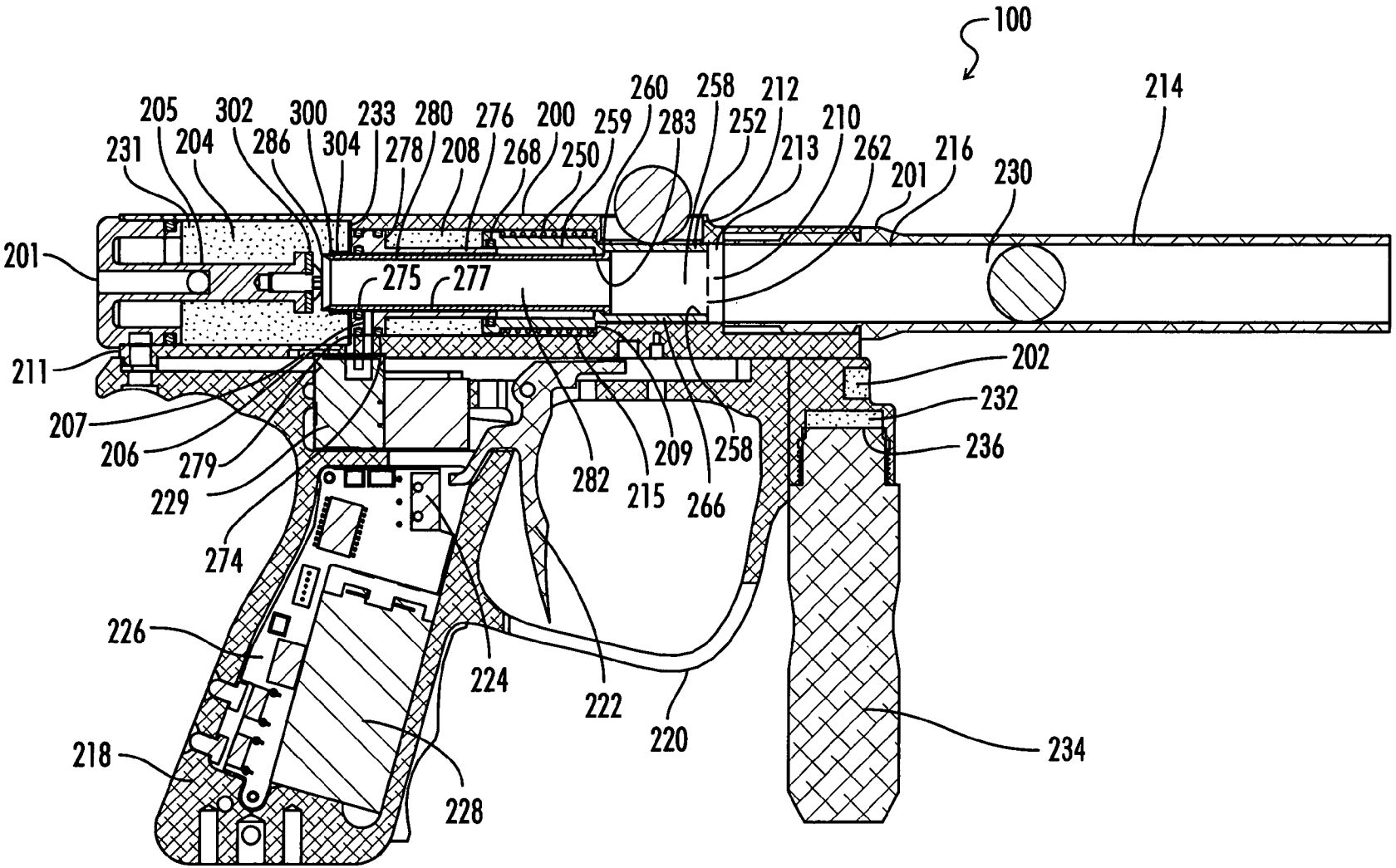
FIG. 2 is a schematic view of a paintball gun showing the internal firing position.

Upon sensing the pull of the trigger 222, the circuit board 226 uses an electric signal to change the position of the three way control valve 229 to that shown in FIG. 2. The control valve 229 is now connecting the main gas chamber 204 with the controlling gas passage 206 so that pressurized gas 232 can flow to the back 254 of the bolt 250. The force of the pressurize3d gas 232 on the back 254 of the bolt 250 overcomes the force of the bolt spring 270 and forces the bolt 250 forward. As the bolt 250 moves forward, the front 252 of the bolt 250 chambers a paintball 230 into the rear 216 of the barrel 214. The impact ring 260 of the bolt 250 then contacts the striking surface 292 of the power tube 280 to move the power tube 280 forward. The forward movement of the power tube 280 separates the back sealing surface 286 of the power tube 280 from the main seal 302 to allow the pressurized gas 232 to flow out of the main gas chamber 204 and into the inside 282 of the power tube 280. The pressurized gas 232 flows forward through the bolt 250 and out of the gas passages 262 to the paintball 230 to launch the paintball 230 out of the barrel 214.

After an appropriate time delay, the circuit board 226 then shifts the control valve 229 back to the normal position shown in FIG. 1. This again connects the controlling gas passage 206 to the atmospheric pressure passage 207 to relieve the gas pressure from the back 254 of the bolt 250. The bolt spring 270 returns the bolt 250 to the position shown in FIG. 1 so that another paintball 230 can be loaded. Similarly, the valve spring 304 return the power tube 280 to the position shown in FIG. 1 where the back sealing surface presses against the mail seal 302 to seal off the main gas chamber 204 so that the pressure regulator 234 can recharge the main gas chamber 204 for the next operation cycle.

It should be understood that the mechanical springs and pressurized gas systems are interchangeable. For example an easily recognizable alternative would be to include a bolt that uses a spring to propel it forward and compressed gas to move it rearward, or a bolt that uses compressed gas to move it both forward and rearward. Similarly, the electronic valve control could be replaced by the prior art's spring and mechanical sear combinations to control movement of the bolt and the power tube.

Reference numerals used throughout the detailed description and the drawings correspond to the following elements:

paintball marker 100
main body 200
main front 201
main gas passage 202
seal support 201
main gas chamber 204
chamber extension 205
controlling gas passage 206
atmospheric pressure passage 207
bolt chamber 208
bolt stop shoulder 209
breach 210
main bottom 211
paintball supply passage 212
first initial diameter 213
barrel 214
second diameter 215
rear 216
grip frame 218
trigger guard 220
trigger 222
trigger switch 224
circuit board 226
battery 228
three way valve 229
paintballs 230
main chamber diameter 231
pressurized gas 232
a main shoulder 233
pressure regulator 234
outlet 236
bolt 250
front 252
back 254
a spring contact ring 255
outer surface 256
shoulder stop 257
inner surface 258
back internal diameter 259
impact ring 260
gas passages 262
loading position 264
firing position 266
o-ring seal 268
bolt spring 270
annular cylinder 272 large diameter 273
sealing ring 274
tube seal 275
small diameter 276
internal diameter 277
face step 278
back face 279
power tube 280
inside 282
internal tube passage 283
front 284
back sealing surface 286
outer surface 288
main body diameter 290
striking surface 292
outer pressure ring 300
main seal 302
valve spring 304
release valve 306

From the foregoing, it will be seen that this invention well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. A paintball marker apparatus for launching a paintball, the apparatus comprising:

a main body defining a main gas chamber and a breech;

a bolt positioned at least partially inside the main body, the bolt defining an internal surface with an impact ring;

a power tube sized to fit within the bolt, the power tube defining an internal passage to direct gas from the main gas chamber toward the breech, and an external surface with a striking surface, wherein the striking surface of the power tube is sized to contact the impact ring of the bolt; and a main seal positioned to selectively seal to the internal passage of the power tube from the main chamber, wherein movement of the bolt causes the impact ring to contact the striking surface to unseat the power tube from the main seal to release gas from the main gas chamber through the internal passage into the breach to launch the paintball.

a valve;

a main gas passage flowably connected to the main gas chamber or to the valve;

a bolt chamber housing the bolt;

a controlling gas passage flowably connecting the valve to the bolt chamber; and an atmospheric pressure passage flowably connected to the valve.

wherein the valve flowably connects the controlling gas passage to the atmospheric passage.

2. A paintball marker apparatus for launching a paintball, the apparatus comprising:

a main body defining a main gas chamber and a breech;

a bolt positioned at least partially inside the main body, the bolt defining an internal surface with an impact ring;

a power tube sized to fit within the bolt, the power tube defining an internal passage to direct gas from the main gas chamber toward the breech, and an external surface with a striking surface, wherein the striking surface of the power tube is sized to contact the impact ring of the bolt; and a main seal positioned to selectively seal to the internal passage of the power tube from the main chamber, wherein movement of the bolt causes the impact ring to contact the striking surface to unseat the power tube from the main seal to release gas from the main gas chamber through the internal passage into the breach to launch the paintball;

an annular cylinder defining a back face;

the power tube having an outer surface;

an outer pressure ring mounted to the outer surface of the power tube; and a valve spring positioned between the outer pressure ring and the back face.

* * * * *